United States Patent [19]

Taylor

[11] 4,398,555

[45] Aug. 16, 1983

[54] FLOW CONTROL VALVE

[75] Inventor: Donald F. Taylor, Dallas, Tex.

[73] Assignee: Otis Engineering Corporation, Dallas, Tex.

[21] Appl. No.: 269,992

[22] Filed: Jun. 3, 1981

[51] Int. Cl.[3] ..... F04F 1/08

[52] U.S. Cl. ..... 137/155; 251/121

[58] Field of Search ..... 137/155; 251/121, 122

[56] References Cited

U.S. PATENT DOCUMENTS 3,398,760 8/1968 Fox ..... 137/155

3,523,744 8/1970 Holladay ..... 137/155 X

*Primary Examiner*—Alan Cohan

*Attorney, Agent, or Firm*—Roland O. Cox

[57] ABSTRACT

A valve to control flow between outside and inside a tubular member. The valve is housed concentrically in an annular body around a tubular member and may be utilized mounted on an outside mandrel or in a side pocket mandrel which may be included in a well tubing string to control injection or lift gas flow from the well annulus into the tubing. Variable and staged flow restrictors upstream and downstream protect the resilient valve seal from flow cutting and opening closing stresses. The valve is balanced and is not urged to open by increasing outside pressure. The balanced valve minimizes difference between open and close pressures as opening pressure is very near closing pressure. An operating piston, in communication with outside and inside pressures, senses differential pressure and moves the valve axially to open when outside pressure is sufficiently higher than inside pressure. A compressed spring holds the valve closed and opening and closing pressures may be adjusted.

14 Claims, 12 Drawing Figures

FLOW CONTROL VALVE

BACKGROUND OF THE INVENTION

This invention pertains to valves which control flow between outside and inside a tubular member. More specifically, this invention pertains to a valve of the concentric gas lift or chemical injection type, which may be included in a well tubing in a well produced by gas lift methods, to control flow of well annulus pressured lift gas into the tubing, or the valve may also be included in a well tubing to control flow of liquid chemicals from the well annulus "injected" into the tubing to inhibit tubing corrosion, dissolve paraffin, or the like. The control valve of this invention has the same general function in a gas lifted well as the gas lift valves shown in U.S. Pat. Nos. 2,642,889, 2,875,775, and 3,223,109 to Cummings and 2,954,043 to Canalizo. The aforementioned gas lift valves are annular type valves with valve seals of resilient material.

Resilient seals used in gas lift and injection valves are subjected to damaging erosive and abrasive flow. As flow volume through these valves over the seal increases, damage to resilient seals from erosion and abrasion and forces tending to wash the seal away are greater, and damaged seals cause leakage after valve closure. When flow control valves are closed and sealing, higher pressure differentials across the valves induce compressive stresses into the resilient valve seals which cause seal failures, leakage, and initiation of expensive repair procedures. Frequent and repeated stressing and flexure of resilient materials resulting from repeated valve openings and closings also contributes to early failure.

U.S. Pat. No. 4,134,454 to Donald F. Taylor, herein incorporated by reference, discloses a valve generally similar to the control valve of the present invention, in a well production system utilizing a centrifugal pump to produce the well, which is provided with variable and staged flow restrictors upstream and downstream of the valve to protect the resilient valve seal and greatly extend its operational life. None of the prior patents found show or teach the use of the valve of the Taylor patent in gas lift or chemical injection well systems.

SUMMARY

The present invention provides a valve which is useful in wells produced by gas lift, in wells requiring injection of liquid chemicals into the tubing string, or any well requiring fluids to be caused to flow from an annulus or region outside a well tubing to inside the tubing. The present valve includes all the features of the valve of U.S. Pat. No. 4,134,454 to Taylor, and in addition there are provided flow passages to communicate pressure outside the control valve with a pressure responsive operating piston. The annular operating piston is mounted on a tubular mandrel which is connected to the valve, and communication passages are provided to expose pressures inside the valve to the opposing side of the operating piston; therefore, any pressure difference between outside and inside pressures is sensed by the operating piston. An outside pressure is increased to a pressure sufficiently above inside pressure and the operating piston develops sufficient down force to overcome the compressed spring holding the valve up and closed, the valve is moved axially down and opened to admit flow of lift gas or liquid chemical from outside through flow passages in the control valve wall and a series of variable flow restrictors to inside the tubular mandrel and into any well product therein.

As pressure increases inside, reducing differential pressure across the operating piston sufficiently, the compressed spring moves the valve, operating piston mandrel, and operating piston up to close the valve, shutting off flow. As different rate springs may be used or spring compression may be changed by addition or removal of washers of various thicknesses, control valve opening closing pressures may be adjusted to very near the same pressure separated by only seal friction pressure requirements. The valve is balanced in the closed position by an additional seal on the valve closure member equal in sealing area to that of the valve closure seal and therefore is not urged to open by increasing pressures exterior or interior of the valve. The balancing seal limits pressure differential on seat forces from inducing high compressive stresses into the resilient closure seal when the control valve is closed, further extending the useful life of the closure seal. It should be understood a flow control valve embodying this invention is particularly useful in intermitting gas lifted wells and could be utilized in side pocket or on outside type gas lift mandrels which may also be included in well tubing strings.

An object of this invention is to provide an improved valve for controlling flow from well annulus regions outside a tubular member to inside the tubular member.

An object of this invention is to provide an improved flow control valve with operating means responsive to pressure differences between outside and inside pressures.

Another object of this invention is to provide an improved flow control valve with a flow passage for communicating fluid outside the valve with the pressure responsive operating means.

An additional object is to provide an improved flow control valve with opening and closing pressures near the same.

An additional object of this invention is to provide an improved flow control valve with variable open-close pressures.

Another object is to provide an improved flow control valve with variable staged flow restrictors which protect and greatly extend the life of the resilient valve seal.

A further object is to provide an improved flow control valve which is balanced when closed and not urged to open by increasing exterior pressure.

An additional object of this invention is to provide an improved flow control valve with an isolated flow passage for operating and injecting fluid.

BEST MODE FOR CARRYING OUT THE INVENTION

Figure 1:
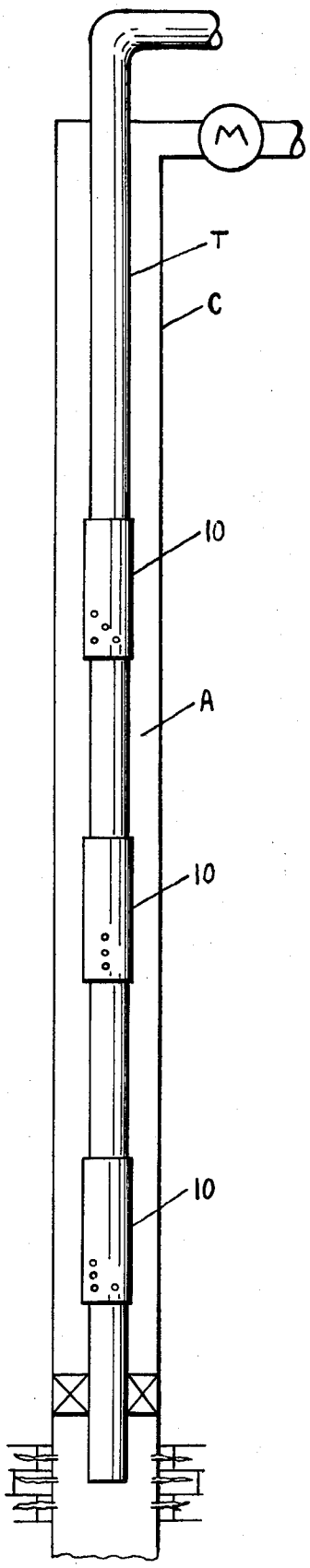
FIG. 1 is a schematic drawing of a well completed for gas lift production or chemical injection, utilizing control valves of the present invention.
Figure 2A:
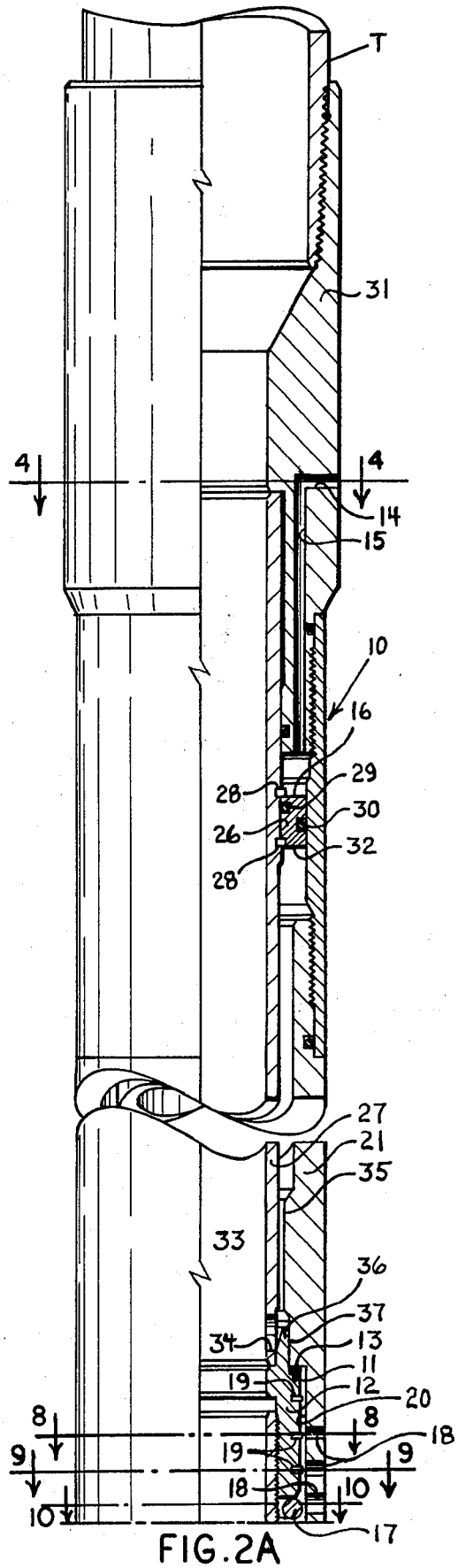
FIGS. 2A and 2B comprise an elevational view, half sectioned, of the control valve of the present invention shown in the "on-seat" or closed position.
Figure 2B:
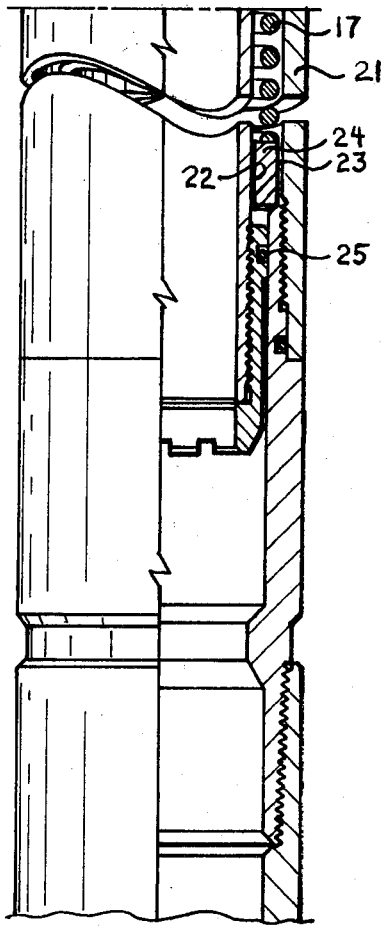
Figure 4:
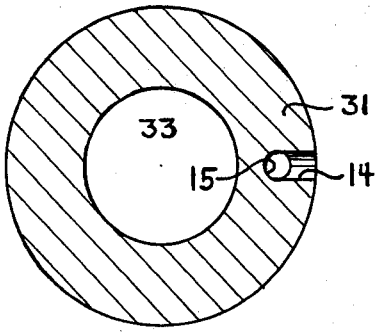
FIG. 4 is a cross-sectional view of FIGS. 2A on line 4—4.

Referring now to FIG. 1, there is shown schematically three control valves 10, of the present invention, made up in a tubing string T and installed in a well completed to produce fluids up the tubing to surface using a conventional gas lift system. A motor valve M, at the surface, controls pressurized gas admitted to the tubing/casing annulus A exterior of control valve 10. Referring now to FIG. 2, pressurized gas from annulus A enters connecting flow passages 14 and 15 to act on first piston pressure responsive surface 16.

At the same time, pressurized annulus gas enters ports 18, flows between restrictor flanges 19 and bore 20 in lower housing 21 to act on the sealed area of resilient valve closure seal 11. Pressurized gas after entering ports 18 also flows through clearances 22 and 23, inside and outside of spring spacer 24, to act on the sealed area of balancing resilient seal 25.

In a preferred embodiment shown in FIG. 2, the seal 11 of valve closure member 12 in control valve 10 is held on the annular seat 13 position by compressed spring 17, preventing pressurized fluid in annulus A exterior of control valve 10 from flowing through lateral ports 18, between restrictor flanges 19 and bore 20 of lower housing 21. The sealed areas of seal 11 and seal 25 are equal, therefore, increasing annulus gas pressure does not urge the valve closure member 12 to move axially on or off seat 13, and as the valve closure member 12 is held on seat 13 by compressed spring 17, the valve is "balanced" in the "on-seat" or closed position.

It has been shown that pressurized annulus gas through ports 18 does not tend to move the balanced valve off seat. At the time annulus pressure through ports 18 acts on seals 11 and 25, the same exterior annulus pressure acts through connecting passageways 14 and 15 on piston surface 16 on operating piston 26. Operating piston 26 is positioned on mandrel 27 with retaining rings 28 and sealed thereto with seal 29. Sliding seal 30, carried on piston 29 seals the piston while it slides inside upper housing 13.

A second pressure responsive surface 32 on piston 26 is in communication with pressure in flow passage 33 interior of the control valve 10, through mandrel ports 34 and annular flow passage 35.

To open control valve 10 and allow flow from annulus A exterior of the valve into longitudinal flow passage 33 interior of the valve, motor valve M is opened to admit pressurized gas to annulus A until the gas pressure acting on piston surface 16 produces sufficient off-seat force to overcome on-seat forces produced by interior pressure in passage 33 acting on piston surface 32 and compressed spring 17 force. When this annulus pressure is reached, see FIGS. 3A and 3B, operating piston 26 moves mandrel 27 and valve closure member 12 with seal 11 axially off seat 13 permitting flow from annulus A exterior of the valve through lateral ports 18, between restrictor flanges 19 and bore 20, between seal 11 and annular seat 13, between extension 36 on closure member 12 and bore 37 through mandrel ports 34 and into flow passage 33. In a gas lifted well, lift gas would flow from annulus A through control valve 10 into flow passage 33 to aereate liquid from the producing formation therein and "lift" the lightened liquid to surface.

One or more of the control valves of this invention previously described may also be utilized in a well which requires liquid chemicals to be injected into the tubing interior from an exterior tubing casing annulus, such as annulus A, FIG. 1. The control valve would be operable for chemical injection in the same manner as when used as a control valve in a gas lifted well.

Figure 7:
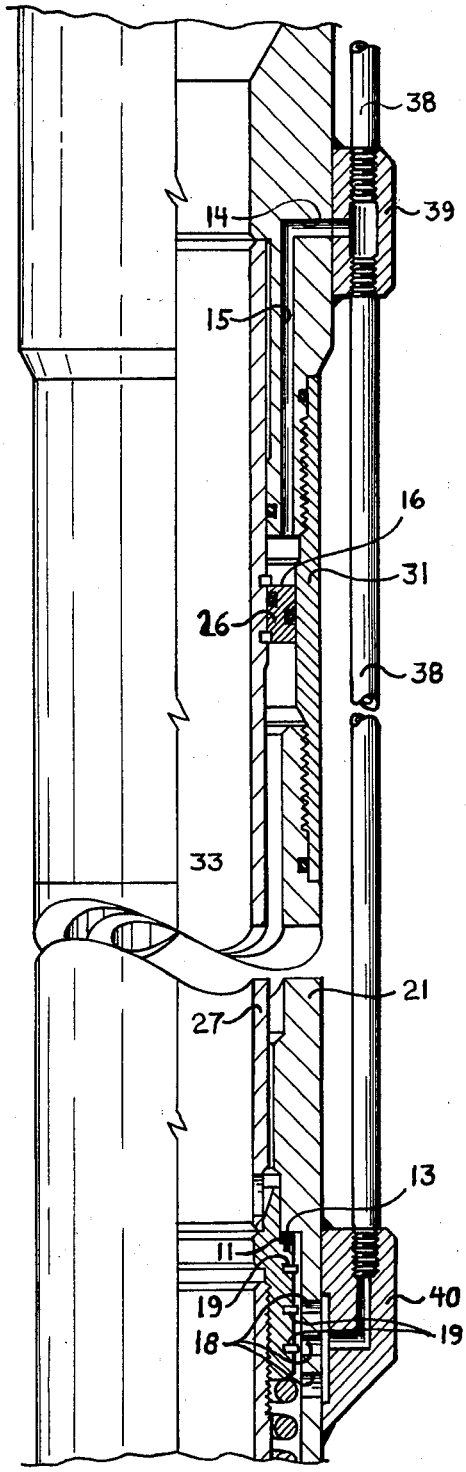
FIG. 7 is a fragmentary enlarged view showing a control line attached to the control valve upper housing flow passage.

FIG. 7 depicts a control valve 10 of this invention with conduit 38, which extends from surface in the well annulus, connected to a lug 39 which has been positioned over flow passage 14 and welded to upper housing 31 to establish an isolated flow passage from surface through conduit 38 and flow passages 14 and 15 to pressure responsive surface 16 on operating piston 26. More conduit 38 connects lug 39 to lower lug 40 which has been positioned over lateral ports 18 and welded to lower housing 21 extending the flow passage from surface to flow passage 14 and to ports 18. It should be apparent that lower lug 40 could be positioned over only one lateral port 18 for the same function.

This embodiment of the invention, which also may be utilized, usually one control valve per well, for chemical injection, provides a desirable combination isolated flow passage for chemicals and a pressure communication passage with operating piston 26 from surface in one conduit. The isolated flow passage prevents contact of chemicals with or contamination by any gases or liquids which may be in the well annulus. As the volume of the conduit and flow passages from surface is much less than the volume of a well annulus, much less chemical is required and direct control over chemical volume and pressure is provided.

Pressure applied to chemicals in conduit 38 at surface applies opening force on first pressure responsive surface 16 on operating piston 26 and at the same time delivers chemical fluids to balance seal 25 and seal 11 and seat 13 for injection.

It should be noted, on examination of FIG. 7, that conduit 38 could terminate at its connection with flow passage 14 and not extend downward to lug 40. This embodiment of the control valve is operable by control fluid in the conduit 38 to permit flow from exterior well annulus to the interior flow passage 33 of the valve. Alternately, conduit 38 could be connected directly to lug 40 with no lug 39 connected to passageway 14. This embodiment would provide an isolated flow passage from surface for chemicals to inject into tubing, and the valve is operable with annulus fluid pressured at surface.

Figure 3A:
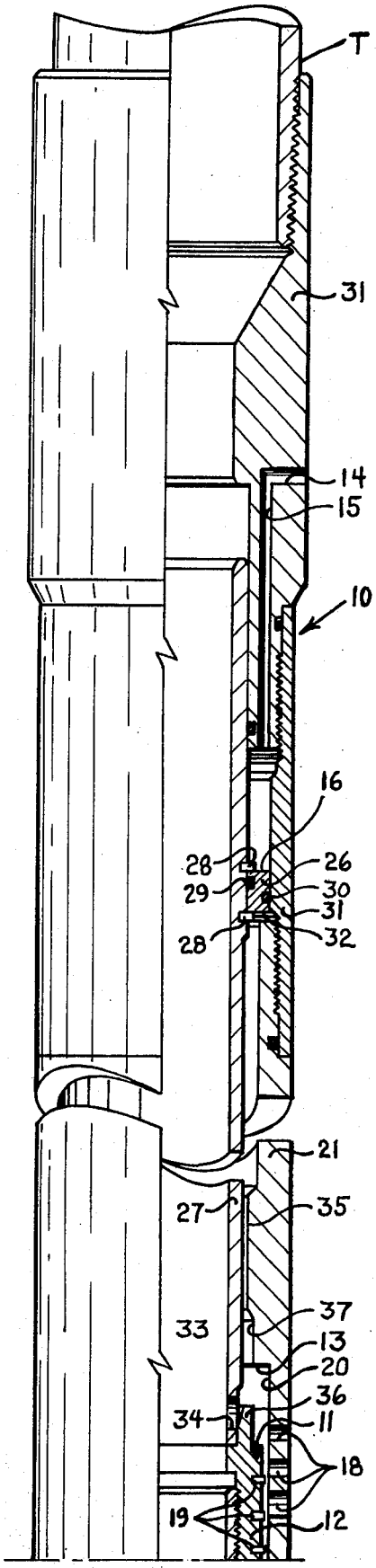
FIGS. 3A and 3B comprise an elevational view, half sectioned, of the present invention valve in the "off-seat" or open position.
Figure 3B:
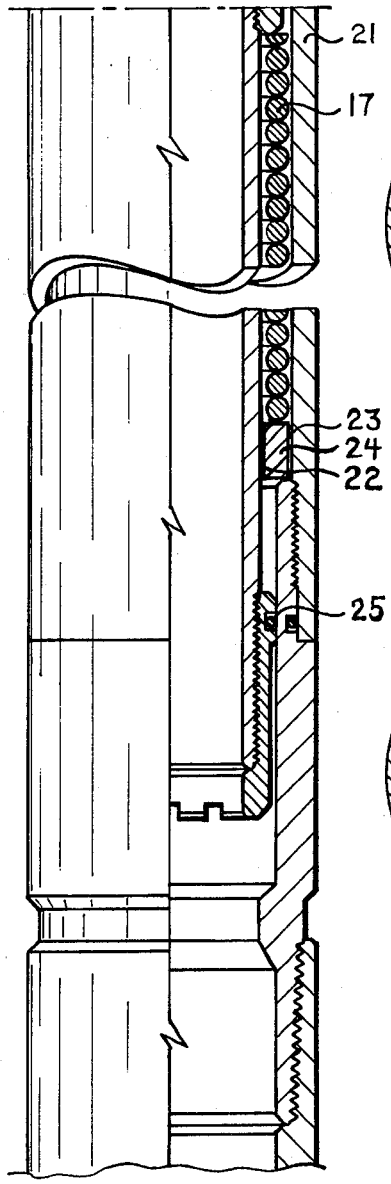
Figure 8:
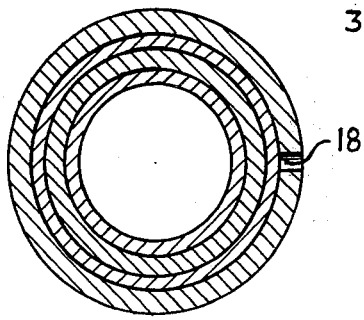
FIG. 8 is a cross section of FIG. 2A on section line 8—8.
Figure 9:
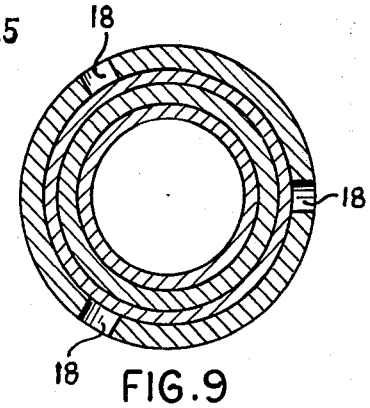
FIG. 9 is a cross section of FIG. 2A on section line 9—9.
Figure 10:
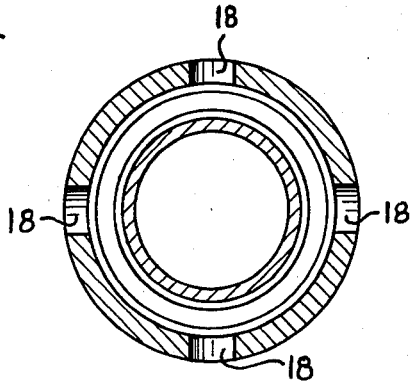
FIG. 10 is a cross section of FIG. 2A on section line 10—10.
Figure 5:
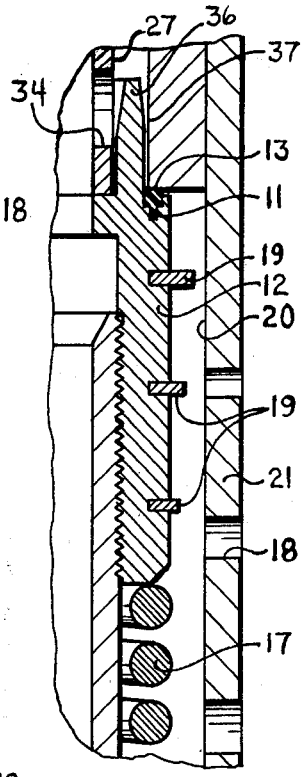
FIG. 5 is a fragmentary enlarged view of the valve area of the control valve, showing restrictor flanges decreasing in diameter and restrictor ports increasing in diameter as they are spaced further from the resilient valve seal.
Figure 6:
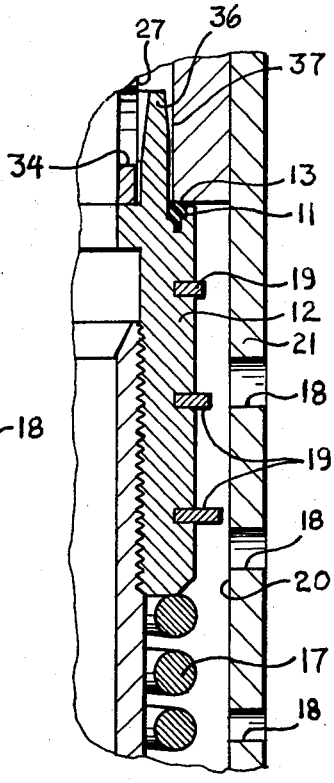
FIG. 6 is the same view as FIG. 5, but with restrictor flanges increasing in diameter and restrictor ports decreasing in diameter as they are spaced further from the resilient valve seal.

The variable and staged flow restriction system of this control valve (FIGS. 5 and 6) protects the resilient valve closure seal 11 from abrasive and erosive flow by not using the valve closure seal 11 and seat 13 as restrictors of flow through the valve. When valve closure seal 11 is off annular seat 13 and pressure exterior control valve 10 is sufficient to cause flow to the interior flow course 33, flow must pass through three stages of restriction, of which the initial stage of restriction offers more restriction to flow than seal 11 and seat 13. One flow restrictor consists of lateral ports 18 in lower housing 21. In FIGS. 2A and 3A the ports 18 are shown to increase in size as their planes are spaced from seat 13. If desired, the port sizes could be arranged in reverse as shown in FIG. 6. FIGS. 8, 9, and 10 show planes with one, two, and three ports respectively. It should be understood that the number and size of ports per plane may be varied to gain desired stage restriction.

The initial stage of flow restriction is encountered immediately after closure seal 11 is moved off seat 13, and flow occurs between the outside diameter of closure extension 36 and lower housing bore 37, with the length of extension 36 being variable as to the length of operational time required of this restriction before the second stage of restriction comes into operation during the opening or closing sequence of the valve.

The second stage of flow restriction occurs as a transition stage while the closure extension 36 is being withdrawn from the lower housing bore 37 so as to prevent further differential pressure from acting across seal 11 as the valve continues its opening process. This stage of restriction occurs between the outside diameter of the restrictor flange 19 nearest the seal 11 and the inside of housing 20, and before this restrictor flange crosses the first port 18.

Preferably the restrictor flanges 19 may act in a similar fashion as automotive piston rings where the outside diametral surfaces of the restrictor rings ride against the inside wall of the housing 20 with the exception that the restrictor flange 19 nearest the seal 11 has a predetermined gap between the circumferential ends of the flange, so as to meter the flow temporarily into the bore 33 during the opening sequence of the valve.

The third stage of flow restriction occurs after the restrictor flange 19 nearest the seal 11 passes the port 18 nearest the seat 13. The gap between ends of the near flange 19 or the annular flow area between the outside diameter of the restrictor flange 19 and the bore 20 of housing 21 permits a flow volume which may be considered constant for the purpose of explanation. As this restrictor 19 passes the port 18, this volume remains constant. The effect is then to add the volume flowing through port 18 to this volume, thus increasing the flow past the seal 11 into bore 33. As this restrictor 19 passes additional ports 18, spaced longitudinally (FIGS. 2A and 3A), more flow volume is admitted to bore 33 until restrictor flanges 19 move as far away from seat 13 as permitted.

It should be understood that the outside diameters of restrictor flanges 19 may be the same or may be varied in any order or randomly to create desired flow restriction between the outside diameters of the flanges and housing bore 20.

When pressure in the annulus A or conduit 38 is decreased below that required to open the valve, the valve, moved by closure means 17, then starts to close. As the valve seal 11 moves toward its seat 13 in housing 21, the reverse sequence flow restrictions occur. The restrictor flanges 19 away from seal 11 come into operation as they serve now to restrict the additional flow through ports 18, creating differential pressures during the closing process moving the valve to close quickly.

What is claimed is:

1. A valve for use in a flow conductor, comprising:

a. tubular housing connectable in a flow conductor having a plurality of longitudinally spaced lateral ports in the wall thereof communicating the exterior with the interior;

b. annular seat means in said housing spaced longitudinally from said lateral ports;

c. valve closure means slidably mounted in said housing and having a seating surface thereon engageable with said annular seat means, said valve closure means being movable between on-seat and off-seat positions to control flow of fluids through said lateral ports and between the exterior and the interior of said housing;

d. means for moving said valve closure means between said on-seat and off-seat positions; and e. flow restrictor means on said valve closure means movable therewith relative to said lateral ports and said seat means, including a plurality of external flanges which cooperate with said plurality of lateral ports to selectively restrict the flow of fluids entering said housing through said ports.

2. The valve of claim 1, wherein said ports are located in a plurality of longitudinally spaced transverse planes, the flow area of the ports in the individual transverse planes being graduated with the least flow area being in the plane nearest said seat means and the greatest flow area being in the plane farthest from said seat means.

3. The valve of claim 2, wherein said ports are graduated in size in a longitudinal direction, the smallest ports being nearest said seat means and the largest ports being farthest from said seat means.

4. The valve of claim 2, wherein said ports are located in a plurality of longitudinally spaced transverse planes and the number of ports per plane graduated so that the plane nearest the seat means has the least number of ports and the plane farthest from the seat means has the greatest number of ports.

5. The valve of claim 1, wherein said flow restrictor flanges are of uniform size.

6. The valve of claim 1, wherein said flow restrictor flanges on said valve means are graduated in size, the flange nearest the seat means being largest and the flange farthest from the seat means being the smallest.

7. The valve of claim 1, wherein said flow restrictor flanges on said valve means are graduated in size, the flange nearest the seat means being the smallest and the flange farthest from the seat means being the largest.

8. The valve of claim 1, 2, 3, 4, 5, or 6, wherein said seating surface of said valve closure means has an annular groove formed therein and a resilient seal ring is carried in said groove and is engageble with said annular seat means when said valve closure means is in on-seat position.

9. The valve of claim 8, wherein said flow restrictor means includes an annular extension on said valve closure means extending through said annular seat means and having a close free sliding fit therewith, said annular extension permitting very little flow between said annular seat means and said valve seating surface when said valve closure means is in off-seat position and the distance between said seat means and said seat surface is less than a predetermined value.

10. The valve of claim 9, wherein the means for moving said valve closure means includes:

a. resilient means biasing said valve closure means toward on-seat position; and b. means responsive to pressure exterior of said valve for moving said valve closure means to off-seat position when said exterior pressure reaches a value sufficient to overcome said resilient biasing means.

11. The valve of claim 10, wherein said pressure responsive means includes:

a. a piston on said valve closure means sealingly engaging said tubular housing and forming a variable capacity chamber therewith; and b. means for conducting operating fluid into said chamber to act on said piston for moving said valve closure member in opposition to said biasing means.

12. The valve of claim 11, wherein means for conducting operating fluid exterior of the valve into said chamber is a flow passage in the tubular housing wall having one end thereof opening exterior of the valve housing.

13. The valve of claim 11, wherein means for conducting operating fluid into said chamber comprises a conduit connected to said wall flow passage.

14. The valve of claim 13, wherein said conduit connected to said wall flow passage is also connected to said lateral port means whereby pressure of injection fluids supplied to said lateral port means is simultaneously conducted to said chamber to operate the valve.

* * * * *